US009143865B2

(12) United States Patent
Eaton et al.

(10) Patent No.: US 9,143,865 B2
(45) Date of Patent: Sep. 22, 2015

(54) HANDHELD ELECTRONIC DEVICES AND METHODS INVOLVING DISTRIBUTED MODE LOUDSPEAKERS

(71) Applicant: HTC Corporation, Taoyuan, Taoyuan County (TW)

(72) Inventors: William Chris Eaton, Cary, NC (US); Wen-Ping Ying, Bellevue, WA (US)

(73) Assignee: HTC CORPORATION, Taoyuan (TW)

( * ) Notice: Subject to any disclaimer, the term of this patent is extended or adjusted under 35 U.S.C. 154(b) by 177 days.

(21) Appl. No.: 13/898,646

(22) Filed: May 21, 2013

(65) Prior Publication Data

US 2014/0348366 A1 Nov. 27, 2014

(51) Int. Cl.
*H04R 1/00* (2006.01)
*H04R 7/04* (2006.01)

(52) U.S. Cl.
CPC ..... *H04R 7/045* (2013.01); *H04R 2499/15* (2013.01)

(58) Field of Classification Search
CPC ... G06F 1/1601; G06F 1/1605; G06F 1/1616; G06F 1/1624; G06F 1/1641; G10H 1/32; H04R 1/021; H04R 1/2811; H04R 5/02; H04R 7/045; H04R 31/003
See application file for complete search history.

(56) References Cited

U.S. PATENT DOCUMENTS

| | | | | |
|---|---|---|---|---|
| 6,201,878 | B1 * | 3/2001 | Azima et al. | 381/386 |
| 6,243,473 | B1 * | 6/2001 | Azima et al. | 381/152 |
| 6,324,052 | B1 * | 11/2001 | Azima et al. | 361/679.23 |
| 6,332,029 | B1 * | 12/2001 | Azima et al. | 381/152 |
| 6,532,146 | B1 * | 3/2003 | Duquette | 361/679.04 |
| 6,760,456 | B1 * | 7/2004 | Annaratone | 381/306 |
| 6,961,593 | B1 * | 11/2005 | Lonka et al. | 455/573 |
| 7,590,436 | B2 * | 9/2009 | Hulskemper | 455/575.4 |
| 2002/0027999 | A1 * | 3/2002 | Azima et al. | 381/431 |
| 2005/0129267 | A1 * | 6/2005 | Azima et al. | 381/431 |
| 2005/0147273 | A1 * | 7/2005 | Azima et al. | 381/431 |
| 2005/0147274 | A1 * | 7/2005 | Azima et al. | 381/431 |
| 2006/0159293 | A1 * | 7/2006 | Azima et al. | 381/152 |
| 2009/0011805 | A1 * | 1/2009 | Eaton | 455/575.4 |
| 2009/0232333 | A1 * | 9/2009 | Kondo et al. | 381/162 |
| 2011/0123051 | A1 * | 5/2011 | Eaton | 381/162 |

* cited by examiner

*Primary Examiner* — Duc Nguyen
*Assistant Examiner* — Taunya McCarty
(74) *Attorney, Agent, or Firm* — McClure, Qualey & Rodack, LLP

(57) ABSTRACT

Devices and methods involving distributed mode loudspeakers are provided. A representative device includes: a housing defining an interior; a display supported by the housing; a distributed mode loudspeaker supported by the housing, the distributed mode loudspeaker having a driver and a panel, the driver being mounted within the interior and being operative to vibrate the panel, the panel being movable between a stowed position, in which a first portion of the panel is positioned within the interior, and an extended position, in which the first portion of the panel is positioned outside the interior.

19 Claims, 4 Drawing Sheets

HANDHELD ELECTRONIC DEVICES AND METHODS INVOLVING DISTRIBUTED MODE LOUDSPEAKERS

BACKGROUND

From an engineering perspective, providing a loudspeaker for a handheld electronic device (e.g., a laptop computer, tablet computer, smartphone) typically involves a compromise between numerous factors. By way of example, there is typically a desire to provide loud, clear audio, generally associated with relatively large transducers that are adequately spaced from each other. However, the overall size of a handheld device tends to limit the use of such components and arrangements.

SUMMARY

Briefly described, one embodiment, among others, is a handheld electronic device comprising: a housing defining an interior; a display supported by the housing; a distributed mode loudspeaker supported by the housing, the distributed mode loudspeaker having a driver and a panel, the driver being mounted within the interior and being operative to vibrate the panel, the panel being movable between a stowed position, in which a first portion of the panel is positioned within the interior, and an extended position, in which the first portion of the panel is positioned outside the interior.

Another embodiment is a method for operating a handheld electronic device comprising: determining that a panel of a distributed mode loudspeaker is an operative position relative to the electronic device such that, responsive thereto, the distributed mode loudspeaker is enabled to be driven; and determining that the panel is not in the operative position such that, responsive thereto, the distributed mode loudspeaker is disabled.

Other systems, methods, features, and/or advantages of the present disclosure will be or may become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
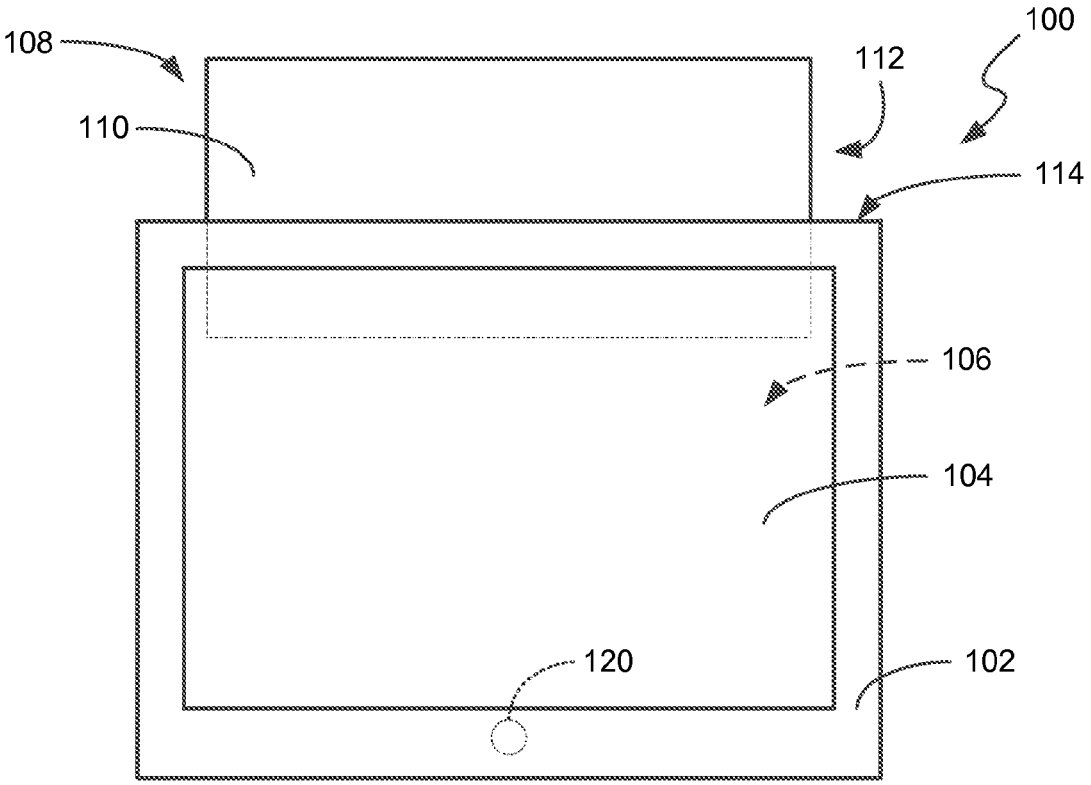
FIG. 1 is a schematic diagram of an example embodiment of a handheld electronic device with a loudspeaker panel in an extended position.

Having summarized various aspects of the present disclosure, reference will now be made in detail to the description of the disclosure as illustrated in the drawings. While the disclosure will be described in connection with these drawings, there is no intent to limit it to the embodiment or embodiments disclosed herein. On the contrary, the intent is to cover all alternatives, modifications and equivalents included within the spirit and scope of the disclosure as defined by the appended claims.

In this regard, devices and methods are provided that involve the use of distributed mode loudspeakers. In some embodiments, a handheld electronic device, such as a laptop computer, tablet or smartphone, incorporates a distributed mode loudspeaker that includes a panel. The panel is selectively movable to an operative position (e.g., an extended position in which a portion of the panel extends outwardly from a housing of the device) so that the panel is positioned for propagating sound waves. In some embodiments, the device may incorporate another loudspeaker (e.g., a diaphragm-based loudspeaker) that is used alternately and/or in addition to the distributed mode loudspeaker to provide sound for the device.

FIG. 1 is a schematic diagram of an example embodiment of a handheld electronic device that incorporates a distributed mode loudspeaker (DML). As shown in FIG. 1, device 100 is configured as a tablet computer that includes a housing 102 and a display 104 that is supported by the housing. Although not depicted in FIG. 1 in detail, housing 102 defines an interior 106 in which various components (not shown) are located. Notably, a DML 108 that includes a movable panel 110 is mounted within the interior 106 beneath the display 104.

Panel 110 of the DML includes a portion 112 that extends outwardly from an upper side 114 of housing 102. The panel 110 is generally rectangular and planar, with a relatively thin profile, and is generally rigid enough to reduce the tendency of the panel to deform based on the extension from the housing. The panel 110 may be formed of various materials, such as plastic, carbon fiber, or corrugated cardboard, for example. In the extended position, the panel 110 is able to propagate highly diffuse (non-directional) acoustic energy responsive to inputs by an associated driver (not shown in FIG. 1).

Figure 2:
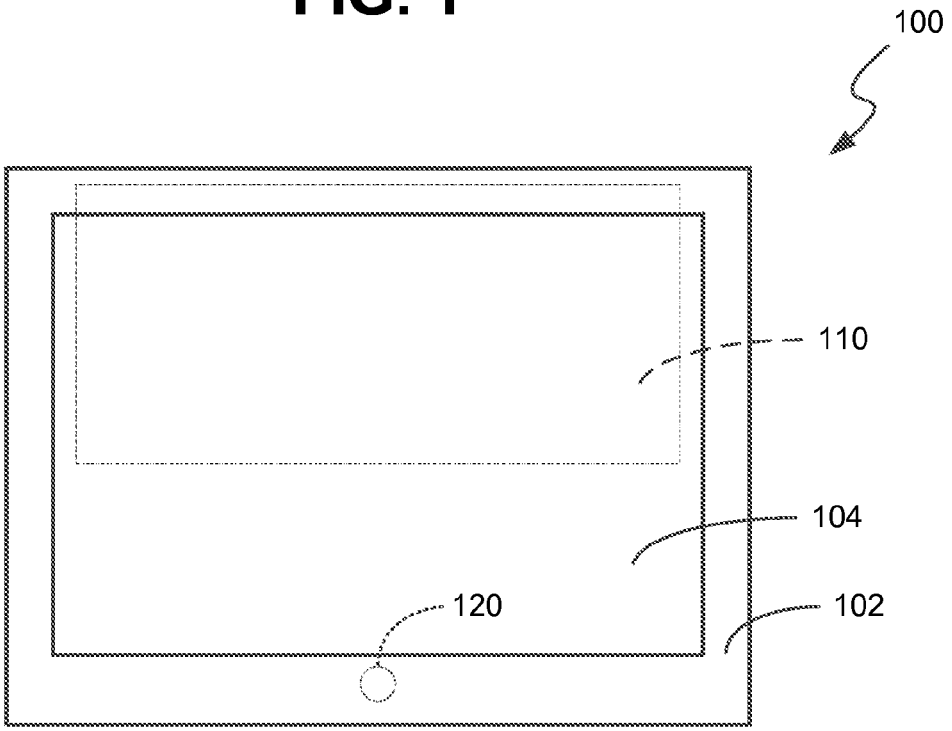
FIG. 2 illustrates the embodiment of FIG. 1 with the panel in a stowed position.

In FIG. 2, the panel 110 is shown in a stowed position. In this embodiment, the entire panel is positioned within the interior of the housing 102 when in the stowed position.

It should also be noted that FIGS. 1 and 2 depict an optional second loudspeaker 120, which may be configured as a diaphragm-based loudspeaker in some embodiments. In operation, the DML 108 and the loudspeaker 120 may be alternately used for propagating acoustic energy in some embodiments. For instance, when the panel 110 is in the extended position, the device may default to using only the DML. However, when the panel is in the stowed position, the device may use only the loudspeaker 120. Alternatively, both loudspeakers may optionally be used simultaneously.

Figure 3:
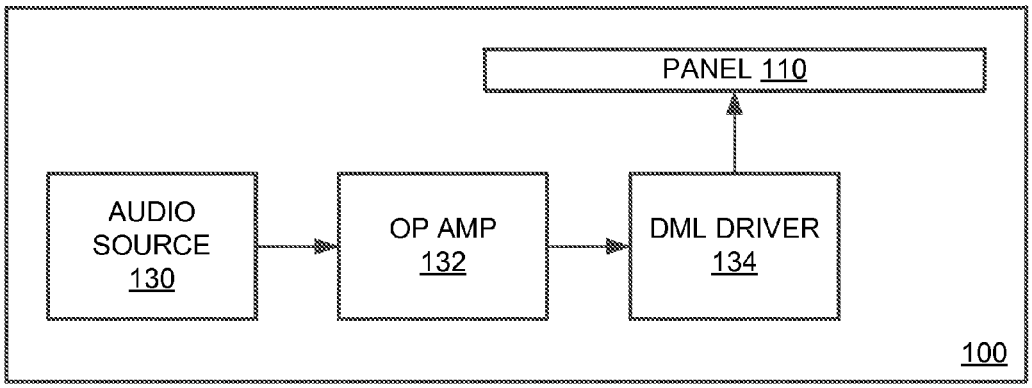
FIG. 3 illustrates the embodiment of FIG. 1 showing detail of the distributed mode loudspeaker.

As shown in more detail in FIG. 3, DML 108 incorporates an audio source 130, an Op amp 132 and a DML driver 134. The DML driver is an electromechanical component that converts electrical signals to mechanical motion in order to transmit impulses to panel 110 for vibrating the panel. Notably, the DML driver 134 is not affixed to the panel 110, but is retained in proximity to the panel so that the impulses of the DML driver may be imparted to the panel without being unnecessarily damped. Various configurations for mounting the components of the DML 108 may be used, such as mounting the audio source 130, Op amp 132 and DML driver 134 to a circuit board or interior wall of the housing, for example.

Figure 4:
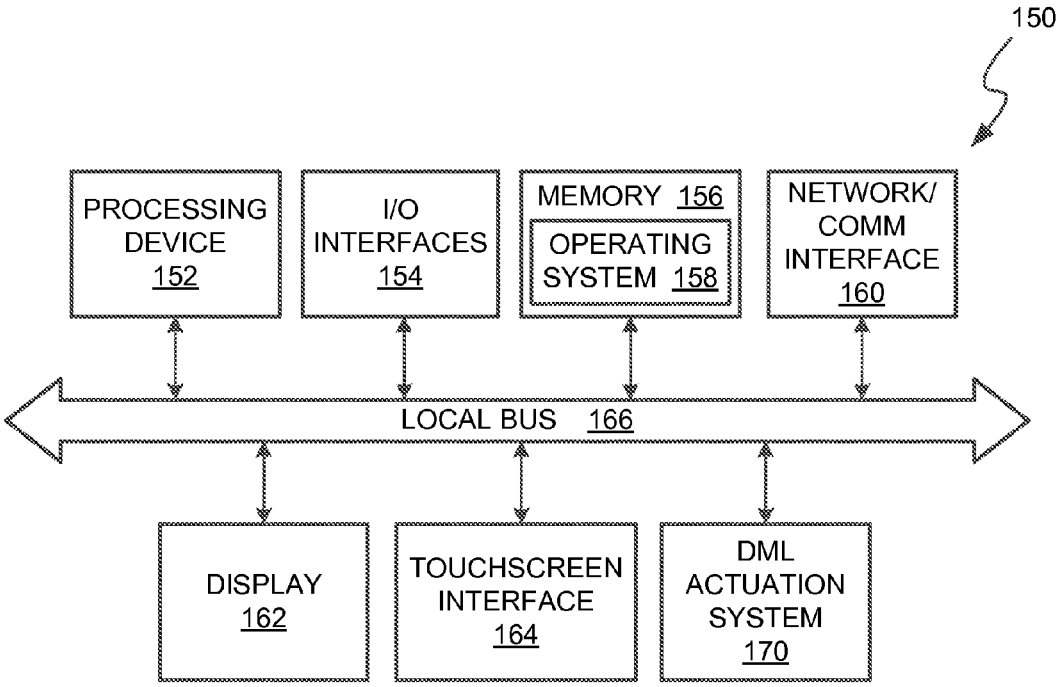
FIG. 4 is a schematic diagram of an example embodiment of a handheld electronic device.

FIG. 4 is a schematic diagram of another embodiment of a handheld electronic device 150 that incorporates a DML. The device 150 may be embodied as a mobile computing device, such as by way of example and without limitation, a smartphone, tablet, or other similar device. The device 150 includes a processor 152, input/output interface(s) 154, a memory 156, an operating system 158, a network interface 160, a display 162, and a touchscreen interface 164, all of which are coupled to a local interface 166.

The local interface 166 may comprise, for example, a data bus with an accompanying address/control bus or other bus structure as can be appreciated.

The touchscreen interface 164 is configured to detect contact within the display area of the display 162 and provides such functionality as on-screen buttons, menus, keyboards, etc. that allow users to navigate user interfaces by touch.

The network interface 160 comprises various components used to transmit and/or receive data over a network environment. By way of example, the network interface 160 may include a device that can communicate with both inputs and outputs, for instance, a modulator/demodulator (e.g., a modem), wireless (e.g., radio frequency (RF)) transceiver, a telephonic interface, network card, etc.) capable of supporting, for example, wide area network (WAN), local area network (LAN) communications.

Operating system 158 is stored in the memory 156 and executable by the processor 152. A number of software components may be stored in the memory 154 (even though depicted separately in FIG. 5, such as in the case o the DML actuation system 170) and executable by the processor 152. In this respect, the term "executable" means a program file that is in a form that can ultimately be run by the processor 152. Examples of executable programs may be, for example, a compiled program that can be translated into machine code in a format that can be loaded into a random access portion of the memory 154 and run by the processor 152, source code that may be expressed in proper format such as object code that is capable of being loaded into a random access portion of the memory 154 and executed by the processor 152, or source code that may be interpreted by another executable program to generate instructions in a random access portion of the memory 154 to be executed by the processor 152, etc. Where any component discussed herein is implemented in the form of software, any one of a number of programming languages may be employed such as, for example, C, C++, C#, Objective C, Java®, JavaScript®, Perl, PHP, Visual Basic®, Python®, Ruby, Delphi®, Flash®, or other programming languages.

An executable program may be stored in any portion or component of the memory 154 including, for example, random access memory (RAM), read-only memory (ROM), hard drive, solid-state drive, USB flash drive, memory card, optical disc such as compact disc (CD) or digital versatile disc (DVD), floppy disk, magnetic tape, or other memory components.

The memory 154 is defined herein as including one or both of volatile and nonvolatile memory and data storage components. Volatile components are those that do not retain data values upon loss of power. Nonvolatile components are those that retain data upon a loss of power. Thus, the memory 154 may comprise, for example, random access memory (RAM), read-only memory (ROM), hard disk drives, solid-state drives, USB flash drives, memory cards accessed via a memory card reader, floppy disks accessed via an associated floppy disk drive, optical discs accessed via an optical disc drive, magnetic tapes accessed via an appropriate tape drive, and/or other memory components, or a combination of any two or more of these memory components.

In addition, the RAM may comprise, for example, static random access memory (SRAM), dynamic random access memory (DRAM), or magnetic random access memory (M RAM) and other such devices. The ROM may comprise, for example, a programmable read-only memory (PROM), an erasable programmable read-only memory (EPROM), an electrically erasable programmable read-only memory (EEPROM), or other like memory device.

Although the DML actuation system 170, and other various components described herein, may be embodied in software or code executed by general purpose hardware as discussed above, as an alternative the same may also be embodied in dedicated hardware or a combination of software/general purpose hardware and dedicated hardware. If embodied in dedicated hardware, each can be implemented as a circuit or state machine that employs any one of or a combination of a number of technologies. These technologies may include, but are not limited to, discrete logic circuits having logic gates for implementing various logic functions upon an application of one or more data signals, application specific integrated circuits having appropriate logic gates, or other components, etc. Such technologies are generally well known by those skilled in the art and, consequently, are not described in detail herein.

Figure 5:
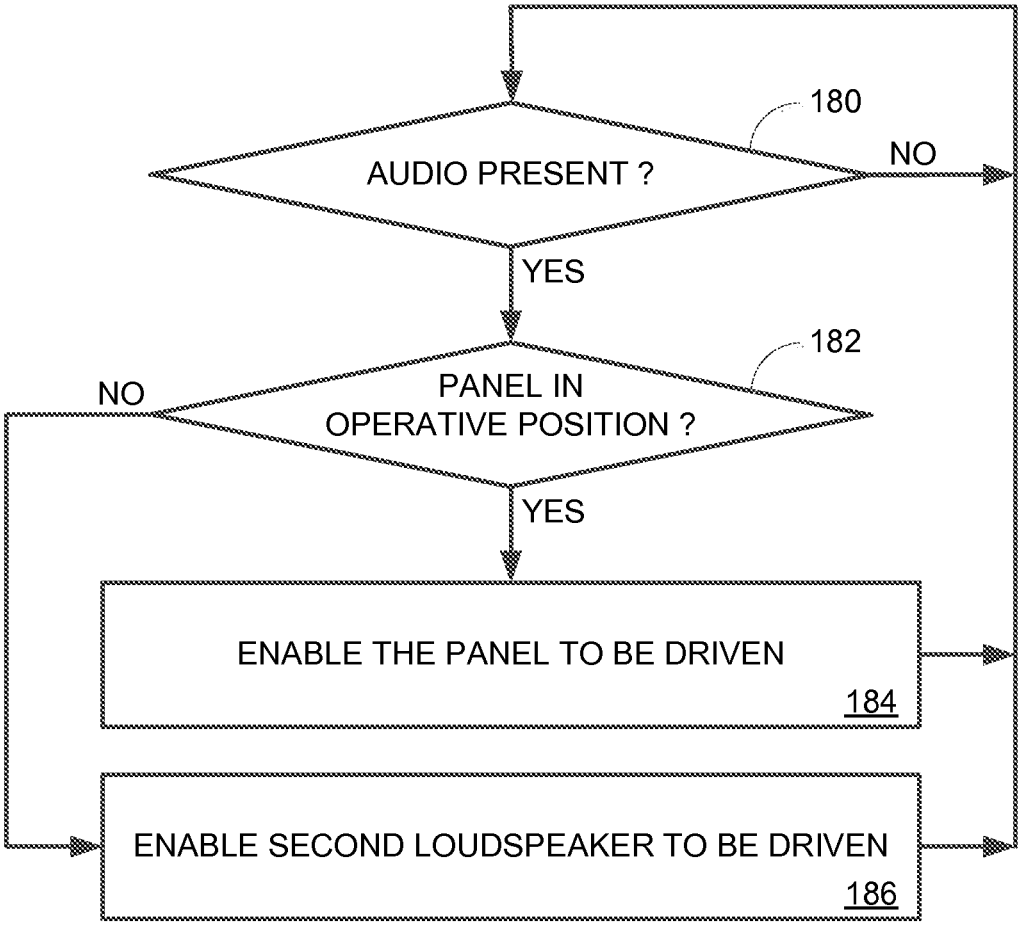
FIG. 5 is a flowchart depicting functionality of an example embodiment of a handheld electronic device.

The flowchart of FIG. 5 shows an example of functionality of an implementation of DML actuation system 170 of FIG. 4. If embodied in software, each block may represent a module, segment, or portion of code that comprises program instructions to implement the specified logical function(s). If embodied in hardware, each block may represent a circuit or a number of interconnected circuits to implement the specified logical function(s).

Although the flowchart herein shows a specific order of execution, it is understood that the order of execution may differ from that which is depicted. For example, the order of execution of two or more blocks may be scrambled relative to the order shown. Also, two or more blocks shown in succession may be executed concurrently or with partial concurrence. Further, in some embodiments, one or more of the blocks may be skipped or omitted. In addition, any number of counters, state variables, warning semaphores, or messages might be added to the logical flow described herein, for purposes of enhanced utility, accounting, performance measurement, or providing troubleshooting aids, etc. It is understood that all such variations are within the scope of the present disclosure.

FIG. 5 is a flowchart depicting functionality of an example embodiment of a handheld electronic device. As shown in FIG. 5, the functionality (or method) may be construed as beginning at block 180, in which a determination is made as to whether audio is present. By way of example, such a determination may be based on whether an associated audio source (e.g., audio source 130 of FIG. 3) is active. If it is determined that audio is present, the process may proceed to block 182, in which a determination is made as to whether a panel of a DML is in an operative position (e.g., an extended position). If it is determined that the panel is in an operative position, the process may proceed to block 184, in which the panel is enabled so that sound may be provided by the DML.

If, however, the panel is not in an operative position, the process may proceed to block 184, in which a second loudspeaker of the device (e.g., a diaphragm-based loudspeaker) is enabled. Notably, the process flows from blocks 184 and 186, as well as the negative result from the inquiry in block 180, may return to block 180 and proceed as described before.

Figure 6:
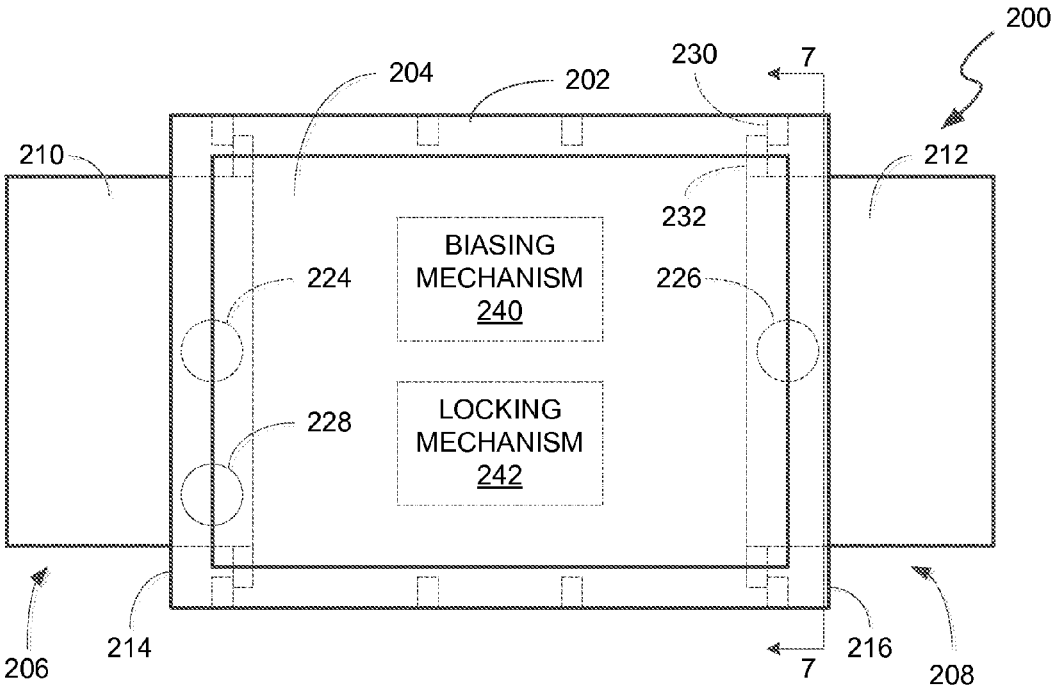
FIG. 6 is a schematic diagram of an example embodiment of a handheld electronic device with speaker panels in extended positions.
Figure 7:
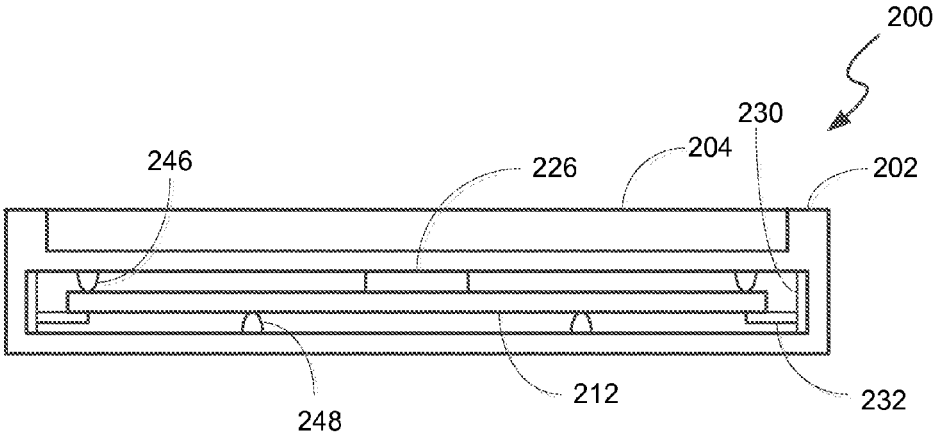
FIG. 7 illustrates the embodiment of FIG. 6 showing detail of the panel as viewed along section line 6-6.

FIGS. 6 and 7 are schematic diagrams of another example embodiment of a handheld electronic device, with FIG. 7 showing a cross-section of that depicted in FIG. 6. As shown, device 200 is configured as a tablet computer that includes a housing 202 and a display 204 supported by the housing. Device 200 also includes DMLs 206 and 208. In particular, DMLs 206 and 208 incorporate panels 210 and 212, respectively, with panel 210 being located adjacent side 214 of the housing and panel 212 being located adjacent opposing side 216.

In the respective extended positions (depicted in FIG. 6), panel 210 includes a portion that extends outwardly from the housing 202 (i.e., from an opening), whereas panel 212 includes a portion that extends outwardly from the housing 202.

Also depicted are DML drivers 224, 226, with each being arranged to drive a corresponding panel. Notably, an optional additional DML driver 228 is depicted in association with panel 210, exhibiting an embodiment in which multiple drivers may be used with a single panel to vibrate the panel in different modes.

In order to set the extent of movement of a panel in the extended position, the device incorporates mechanical stops (e.g., stop 230). The stops are oriented to engage corresponding features of the panels. In this embodiment, the features are tabs (e.g., tab 232) that are affixed to the panels.

In this embodiment, the panels are biased to their respective extended positions by a biasing mechanism 240 (e.g., a spring assembly). A locking mechanism 242 (e.g., a latch assembly) also is provided that is operative to selectively lock the panel in the stowed position, thereby preventing the biasing force of the biasing mechanism from retaining the panels in the extended positions.

As shown in FIG. 7, panel 212 is positioned within the interior 242 of the housing beneath the display 204. The DML driver 226 is positioned between the display 204 and the panel 212, with the panel being retained in a relatively parallel orientation with respect to the display by flexible mounts (e.g., mount 246, 248). In this embodiment, the mounts are configured as springs that enable the panel to be held against the DML driver during actuation while permitting the panel to slide through the opening along a range of positions between the stowed and extended positions. Although the numbers, orientations and configurations of mounts may vary among embodiments, the embodiment depicted in FIG. 7 includes a pair of mounts on an upper side and another pair of mounts on a lower side of each panel.

In the context of the present disclosure, a "computer-readable medium" can be any medium that can contain, store, or maintain the logic or application described herein for use by or in connection with the instruction execution system. The computer-readable medium can comprise any one of many physical media such as, for example, magnetic, optical, or semiconductor media. More specific examples of a suitable computer-readable medium would include, but are not limited to, magnetic tapes, magnetic floppy diskettes, magnetic hard drives, memory cards, solid-state drives, USB flash drives, or optical discs.

Also, the computer-readable medium may be a random access memory (RAM) including, for example, static random access memory (SRAM) and dynamic random access memory (DRAM), or magnetic random access memory (MRAM). In addition, the computer-readable medium may be a read-only memory (ROM), a programmable read-only memory (PROM), an erasable programmable read-only memory (EPROM), an electrically erasable programmable read-only memory (EEPROM), or other type of memory device.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

At least the following is claimed:

1. A handheld electronic device comprising:

a housing defining an interior;

a display supported by the housing;

a distributed mode loudspeaker supported by the housing, the distributed mode loudspeaker having a driver and a panel, the driver being mounted within the interior in sliding contact with the panel and being operative to vibrate the panel, the panel being biased into contact with the driver and movable relative to the driver between a stowed position, in which a first portion of the panel is positioned within the interior such that the driver contacts the panel at a first position, and an extended position, in which the first portion of the panel is positioned outside the interior such that the driver contacts the panel at a second position.

2. The device of claim 1, wherein the driver is positioned between the display and the panel.

3. The device of claim 1, wherein:

the device further comprises a sidewall with an opening formed therethrough; and in the extended position, the panel extends outwardly through the opening.

4. The device of claim 1, further comprising a mechanical stop positioned to define an extent of the extended position of the panel.

5. The device of claim 4, further comprising a tab extending outwardly from the panel and positioned to contact the mechanical stop in the extended position.

6. The device of claim 1, further comprising a biasing mechanism operative to bias the panel to the extended position.

7. The device of claim 6, further comprising a locking mechanism operative to selectively lock the panel in the stowed position.

8. The device of claim 1, wherein:

the distributed mode loudspeaker is a first distributed mode loudspeaker and the panel is a first panel; and the device further comprises a second distributed mode loudspeaker supported by the housing, the distributed mode loudspeaker having a second panel, the second panel being movable between a stowed position, in which a first portion of the second panel is positioned within the interior, and an extended position, in which the first portion of the second panel is positioned outside the interior.

9. The device of claim 8, wherein the first panel and the second panel are configured to extend from opposing sides of the device.

10. The device of claim 9, wherein:

the housing has opposing upper and lower sides, and opposing left and right sides; and the first panel and the second panel are configured to extend from opposing left and right sides of the device.

11. The device of claim 1, further comprising a conventional diaphragm-based speaker supported by the housing.

12. The device of claim 1, wherein:

the driver is a first driver; and the device further comprises a second driver mounted within the interior and being operative to vibrate the panel such that the first driver and second driver vibrate the panel in different modes.

13. The device of claim 1, further comprising a spring positioned within the interior and having a distal end operative to contact the panel such that the panel is supported along a range of positions between the stowed position and the extended position, wherein the spring biases the panel into contact with the driver.

14. The device of claim 1, further comprising a distributed mode loudspeaker (DML) actuation system operative to enable the distributed mode loudspeaker responsive to determining that the panel is in an extended position.

15. A method for operating a handheld electronic device having a housing, the method comprising:

determining that a panel of a distributed mode loudspeaker is in an operative position corresponding to a first portion of the panel extending outwardly from the housing of the electronic device such that, responsive thereto, the distributed mode loudspeaker is enabled to be driven by a driver mounted within the housing, wherein the driver is in sliding contact with the panel and the panel is biased against the driver; and determining that the panel is not in the operative position such that, responsive thereto, the distributed mode loudspeaker is disabled.

16. The method of claim 15, further comprising enabling a second loudspeaker of the device, which is not a distributed mode loudspeaker, responsive to determining that the panel is not in the operative position.

17. The method of claim 15, wherein:

the device comprises a second loudspeaker, which is not a distributed mode loudspeaker; and the method further comprises selectively driving at least one of the distributed mode loudspeaker and the second loudspeaker.

18. The method of claim 15, further comprising enabling the panel to be moved to the operative position.

19. The method of claim 18, wherein enabling the panel to be moved to the operative position comprises biasing the panel towards the operative position.

* * * * *